US008177695B2

(12) United States Patent
Dellino

(10) Patent No.: US 8,177,695 B2
(45) Date of Patent: May 15, 2012

(54) ABDOMINAL TRAINING MACHINE AND METHOD

(76) Inventor: Fabio Dellino, Bellari-Igea Marina (IT)

( * ) Notice: Subject to any disclaimer, the term of this patent is extended or adjusted under 35 U.S.C. 154(b) by 52 days.

(21) Appl. No.: 12/783,514

(22) Filed: May 19, 2010

(65) Prior Publication Data

US 2011/0287912 A1 Nov. 24, 2011

(51) Int. Cl.
*A63B 26/00* (2006.01)

(52) U.S. Cl. ..... 482/140; 482/93

(58) Field of Classification Search ..... 482/56, 482/92, 93, 94, 96, 100, 133, 134, 135, 136, 482/137, 138, 140, 142, 907; 211/126.5, 211/133.3, 173, 174; 248/125.1, 157
See application file for complete search history.

(56) References Cited

U.S. PATENT DOCUMENTS

| | | | | | |
|---|---|---|---|---|---|
| 4,247,098 | A * | 1/1981 | Brentham | 482/112 |
| 4,638,995 | A * | 1/1987 | Wilson | 482/142 |
| 4,711,448 | A * | 12/1987 | Minkow et al. | 482/100 |
| 4,730,829 | A | 3/1988 | Carlson | |
| 4,854,578 | A * | 8/1989 | Fulks | 482/100 |
| 5,171,198 | A * | 12/1992 | Jones | 482/97 |
| 5,273,508 | A * | 12/1993 | Jones | 482/136 |
| 5,336,149 | A | 8/1994 | Wang | |
| 5,346,447 | A * | 9/1994 | Stearns | 482/96 |
| 5,669,865 | A | 9/1997 | Gordon | |
| 5,810,701 | A * | 9/1998 | Ellis et al. | 482/136 |
| 6,015,372 | A | 1/2000 | Steffee et al. | |
| 6,186,926 | B1 | 2/2001 | Ellis | |
| 6,206,809 | B1 * | 3/2001 | Habing et al. | 482/96 |
| 6,361,481 | B1 * | 3/2002 | Koenig | 482/97 |
| 6,547,701 | B1 | 4/2003 | Eschenbach | |
| 6,575,884 | B1 | 6/2003 | Eazor | |
| 6,645,129 | B2 | 11/2003 | Eschenbach | |
| 7,156,793 | B2 * | 1/2007 | Spiegel | 482/148 |
| 7,857,738 | B2 * | 12/2010 | Reyes | 482/130 |
| 2008/0146419 | A1 | 6/2008 | Chu | |

* cited by examiner

*Primary Examiner* — Loan Thanh
*Assistant Examiner* — Tam Nguyen
(74) *Attorney, Agent, or Firm* — Los Angeles Patent Group; Arman Katiraei

(57) ABSTRACT

Some embodiments provide an abdominal training machine that uses an adapted reverse crunching motion to minimize stress to the knees, back, shoulders, and neck when training the abdominal muscles. The machine combines weight resistance training with a replicated natural motion of each leg to produce the adapted reverse crunching motion. The adapted reverse crunching motion is performed using a section of the lower part of the body closest to the abdominal muscles while the upper body or torso remains stationary. In some embodiments, the abdominal training machine includes a frame, a body support member, and two individually rotating resistance members. Each resistance member includes a weight assembly for providing a user adjustable amount of resistance.

14 Claims, 14 Drawing Sheets

ABDOMINAL TRAINING MACHINE AND METHOD

TECHNICAL FIELD

The present invention relates to an abdominal training machine and method. More particularly, this invention relates to a weight training machine that primarily trains the abdominal muscles using an adapted reverse crunching motion.

BACKGROUND ART

Core training involves strengthening and toning the abdominal muscles between the pelvic and stomach areas. The abdominal muscles include the transverse abdominal, internal obliques, external obliques, rectus abdominus, and the pyramidalis muscles. The abdominal muscles provide postural support in bending, flexing, and overall movement of the mid-section of the body. Additionally, the abdominal muscles facilitate breathing in depressing the thorax when exhaling.

Various training machines and methods have been developed to strengthen and tone the abdominal muscles. A majority of such machines and methods utilize a "stomach crunch" motion whereby the actor produces a force from within the abdominal region to bring the torso or upper body towards the lower body. Different body positioning may be employed (e.g., seated or lying on the floor) and weights may be included to provide resistance when performing the stomach crunching motions.

Other abdominal training machines and methods utilize a "reverse crunching motion". These machines and methods use a variety of leg lifting motions to strengthen and tone the abdominal muscles. Specifically, these machines and methods train the abdominal muscles by requiring the actor to lift the legs from a parallel body position towards a perpendicular body position. Weights may be applied to the feet or ankles to increase resistance in the motion.

Some leg lifting machines and methods require the actor to suspend the body above the ground using the actor's arms to press against an elevated platform. Once suspended, the legs can freely rotate and perform the reverse crunching motion.

Though effective in training the abdominal muscles, these machines and methods also detrimentally impact the body by placing excessive stress on regions of the body that are unrelated to the training of the abdominal muscles. Specifically, abdominal crunching motions place stress on the neck and back especially when weights are applied to the upper body to increase resistance during the crunching motion. Reverse crunching motions place stress on the knees and hips which is further exacerbated when weights are applied to the feet or ankles. Excessive stress may also be applied against the shoulders and back when suspending the body to perform the reverse crunching motion.

The amount of stress and the likelihood of injury may increase from improper technique when using any of the above mentioned abdominal training machines or methods. Machines and methods that do not facilitate a controlled crunch or reverse crunch allow for deviations in technique. Such deviations may distribute excess stress to other parts of the body potentially causing other injuries to result from the abdominal training motions.

Accordingly, there is a need for an improved machine and method to effectively train the abdominal muscles. Such a machine or method should employ a new or adapted motion to minimize stress to other parts of the body thereby reducing the potential for injury to the neck, back, shoulders, knees, hips, and other parts of the body. There is further a need for such a machine and method to include weight resistance to overload train the muscles while providing a controlled motion to prevent deviations in technique.

SUMMARY OF THE INVENTION

Some embodiments provide an abdominal training machine and method that uses a controlled adapted reverse crunching motion to minimize stress to the knees, back, shoulders, and neck when training the abdominal muscles. The machine combines weight resistance training with a replicated and natural independent motion of each leg to produce the adapted reverse crunching motion. In this manner, resistance is targeted to the abdominal muscles with little to no impact to other parts of the body thereby reducing the possibility of injury to the actor.

In some embodiments, the abdominal training machine includes a frame, a body support member, and two individually rotating resistance members. The frame stabilizes the machine and supports the body support member and rotating resistance members. In some embodiments, the frame is composed of a set of steel segments.

The body support member provides a cushion against which the actor rests his body in a supine position. The body support member is angled 15 to 60 degrees from the ground level with a preferred angle of 45 degrees. In some embodiments, the body support member member includes sets of hand grips. Each set of hand grips may be attached at different locations along the body support member or the frame with a different orientation relative to the other sets of hand grips.

Each of the rotating resistance members rotates about a hinge that couples the resistance member to the frame. The hinges are located at a position that is parallel with the hips of the actor using the machine. This position allows for the rotation of the resistance members to replicate the natural rotation of the actor's leg.

Each rotating resistance member includes a pad and a weight assembly. The position of the pad is adjustable to align above the knee or upper thigh of the actor. At this position resistance is applied at a point that is close to the abdominal muscles, but that does not create excess stress to the neck, back, shoulders, knees, and feet of the actor. The weight assemblies support adjustable amounts of weight to increase or decrease the amount of resistance provided by the machine when an actor performs the adapted reverse crunching motion.

To perform the adapted reverse crunching motion, the actor replicates walking or running with the pad of the resistance member located above the knee or thigh of the actor. The leg may be bent at the knee. The actor performs a contraction motion for the adapted reverse crunch by elevating the leg from a parallel body position (i.e., the supine body position). The actor completes the contraction motion and begins the extension motion at any point before, at, or after the actor's leg reaches a perpendicular body position. The pad applies resistance throughout the motion to train the abdominal muscles without stress being applied to the knees, ankle, back, neck, or shoulders. Each leg is able to move independent of the other. This independent motion replicates the natural motion of the legs and facilitates a reverse crunching motion that is natural to the physiology of the human body. Furthermore, the resistance members facilitate a controlled motion that follows the natural rotation of the legs at the hip.

The reverse crunching motion provides primary training of the lower abdominal muscles and outer abdominal oblique muscles and secondary training of the upper abdominal muscles.

BRIEF DESCRIPTION OF THE DRAWINGS

In order to achieve a better understanding of the nature of the present invention a preferred embodiment of the abdominal training machine and method will now be described, by way of example only, with reference to the accompanying drawings in which.

DETAILED DESCRIPTION OF THE INVENTION

In the following detailed description of the invention, numerous details, examples, and embodiments of the abdominal training machine and method are set forth and described. However, it will be clear and apparent to one skilled in the art that the abdominal training machine and method are not limited to the embodiments set forth and that the abdominal training machine and method may be practiced without some of the specific details and examples discussed.

Some embodiments provide an abdominal training machine and method that uses a controlled adapted reverse crunching motion to minimize stress to the knees, back, shoulders, and neck when training the abdominal muscles. The machine combines weight resistance training with a replicated and natural independent motion of each leg to produce the adapted reverse crunching motion. In this manner, resistance is targeted to the abdominal muscles with little to no impact to other parts of the body thereby reducing the possibility of injury to the actor.

I. Abdominal Training Machine

Figure 1:
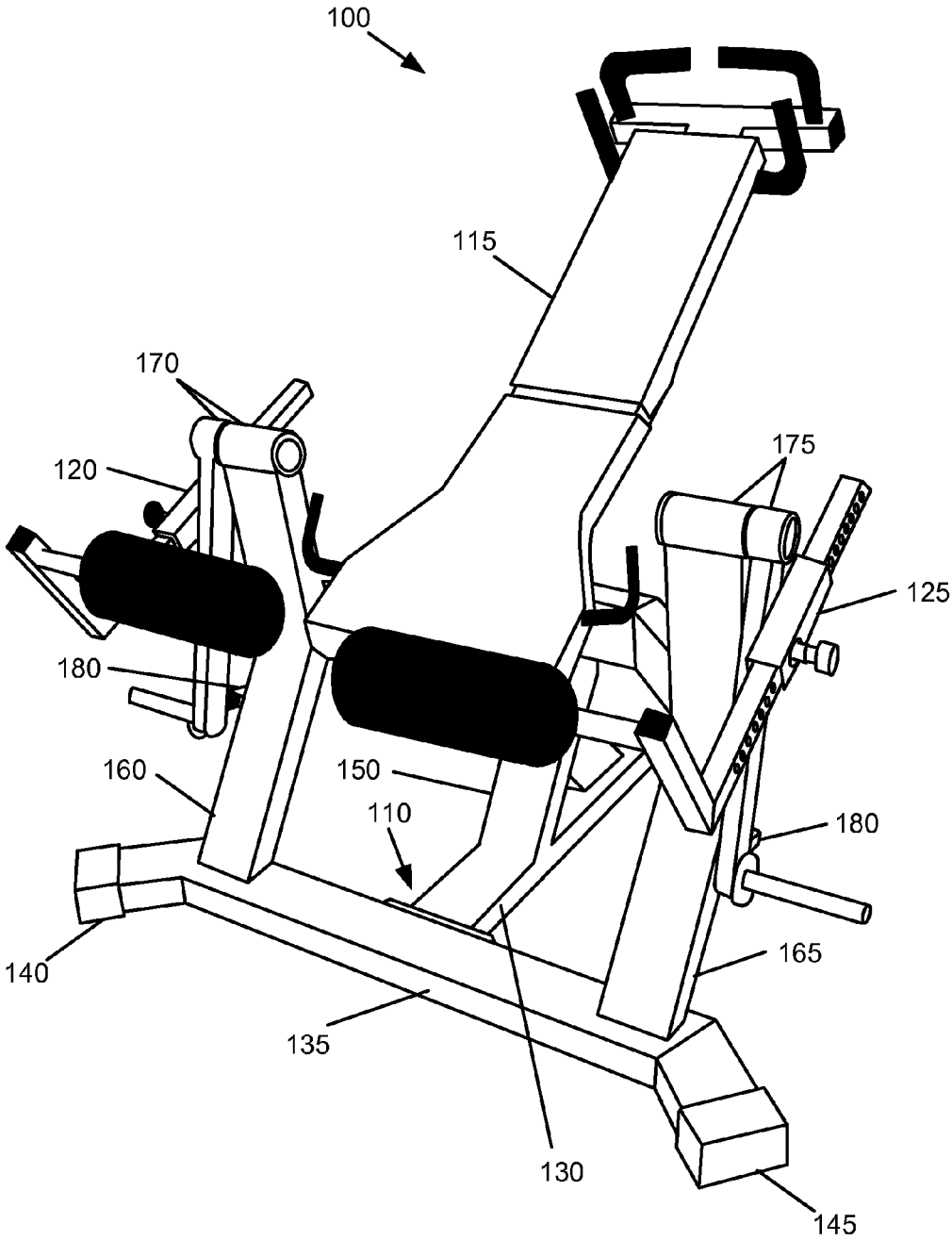
FIG. 1 illustrates the abdominal training machine of some embodiments from a front left perspective.
Figure 2:
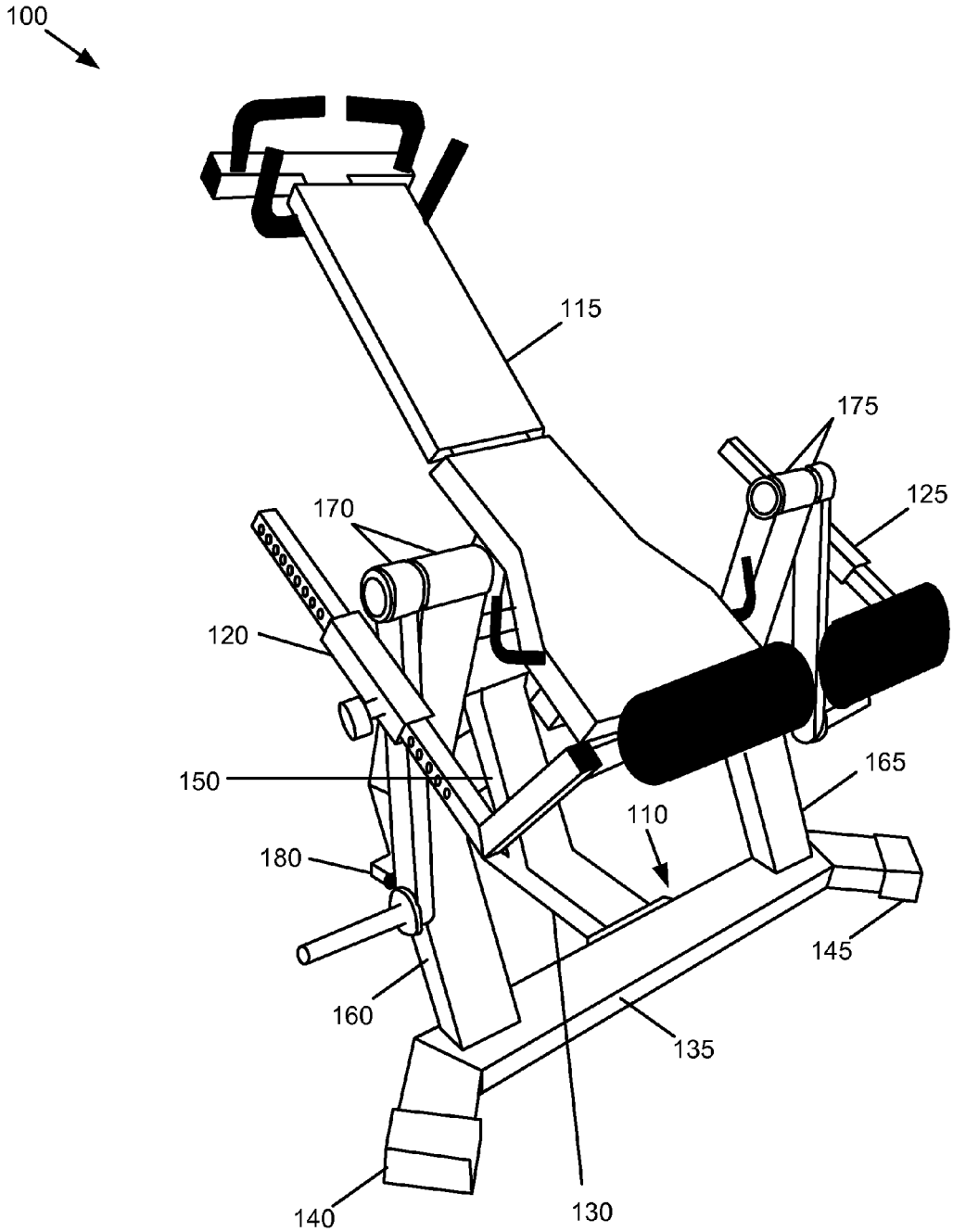
FIG. 2 illustrates the abdominal training machine of some embodiments from a reverse angle (i.e., front right) perspective.
Figure 3:
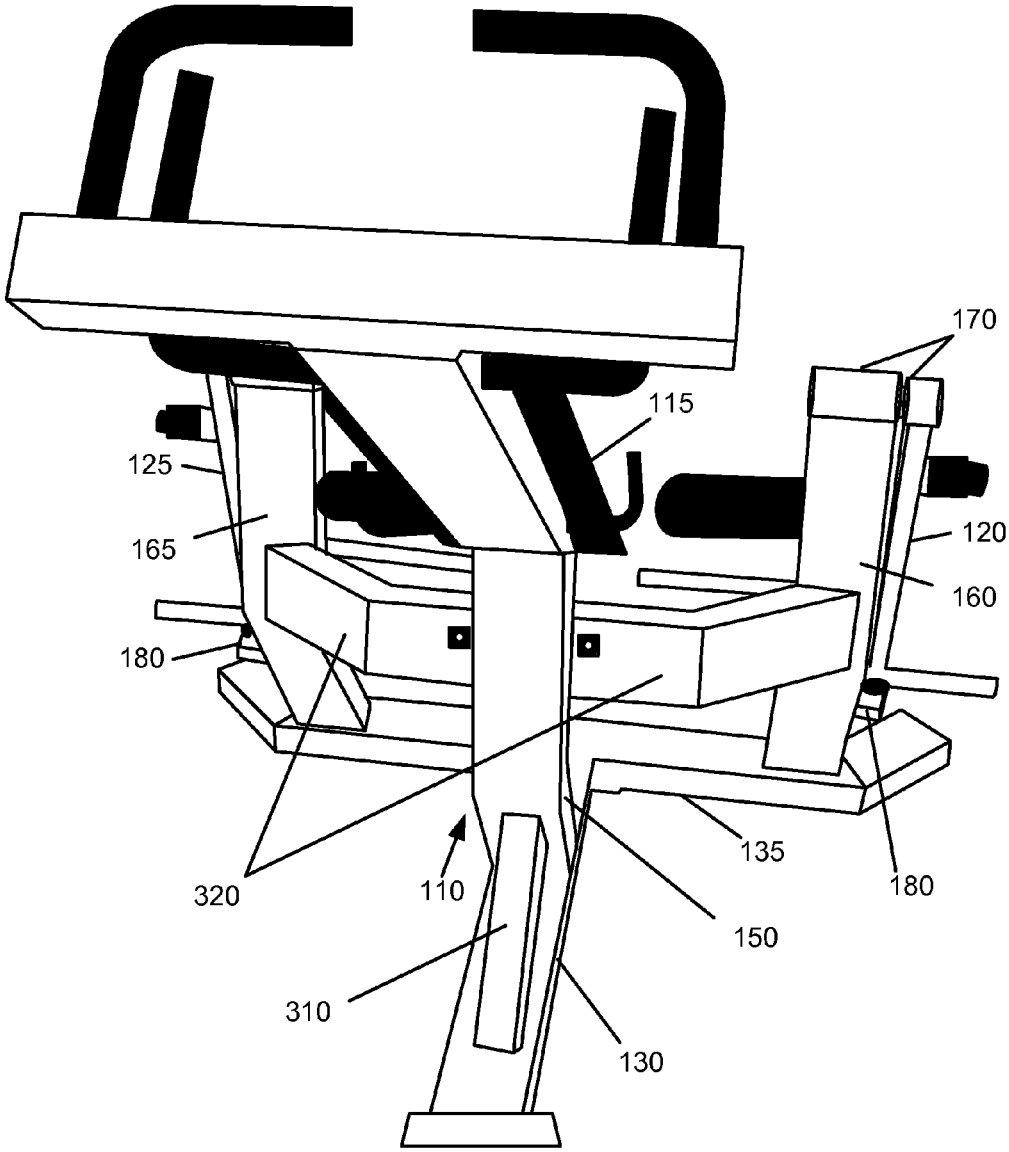
FIG. 3 provides a rear perspective of the abdominal training machine of some embodiments.

FIG. 1 illustrates the abdominal training machine 100 of some embodiments from a front left perspective. Alternate views of the abdominal training machine 100 are presented in FIGS. 2 and 3. Specifically, FIG. 2 provides a reverse angle (i.e., front right) perspective of the machine 100 and FIG. 3 provides a rear perspective of the machine 100. The structural and functional components of the machine 100 are presented in association with FIG. 1. However, FIGS. 2 and 3 may be referred to in order to better illustrate some of the structural and functional components.

The abdominal training machine 100 includes: frame 110, body support member 115, and rotating resistance members 120 and 125. The frame 110 is composed of several rigid segments that are welded or bolted together to provide stability and a foundation for the machine 100 and its other components. In some embodiments, the frame 110 is composed of steel, aluminum, or other rigid materials.

The base of the frame 110 includes a lengthwise extending segment 130 and a widthwise extending segment 135. The lengthwise extending segment 130 couples to the center of the widthwise extending segment 135 to create a "T" shaped base. In some embodiments, the lengthwise extending segment 130 and the widthwise extending segment 135 extend three to six feet, each with a preferred length of four feet. The widthwise extending segment 130 includes end pieces 140 and 145 that extend at an angle of 45 degrees from the widthwise extending segment 130. In some embodiments, rubber caps are placed over each of the end pieces 140 and 145 and the end of the lengthwise extending segment 130 to increase friction between the ground and the base of the frame 110. In this manner, the base of the frame 110 prevents lateral and longitudinal movement of the machine 100 when idle or in use.

As better seen in FIG. 3, the lengthwise extending segment 130 includes a vertically extending segment 150 with a rear brace element 310 that support the body support member 115. A perpendicular cross-member 320 to the vertically extending segment 150 links to and provides additional stability to two vertically extending segments 160 and 165 of the widthwise extending segment 135.

The vertically extending segments 160 and 165 support each of the rotating resistance members 120 and 125. The segments 160 and 165 are positioned a sufficient distance from the body support member 115 to allow an actor to place his body in between the segments 160 and 165. Rotating hinges 170 and 175 are located at the top of the segments 160 and 165.

The hinges 170 and 175 couple the rotating resistance members 120 and 125 to the frame 110 while allowing longitudinal rotation of the members 120 and 125. In some embodiments, the rotating hinges 170 and 175 are aligned parallel with the widthwise extending segment 135. However, it should be apparent that in some embodiments, the rotating hinges 170 and 175 may be angled one to sixty degrees towards or away from the body support member 115 to produce alternate rotating trajectories for the rotating resistance members 120 and 125. Moreover, it should be apparent that in some embodiments, the angle of the rotating hinges 170 and 175 and by extension the angle of the rotating resistance members 120 and 125 is user adjustable.

In some embodiments, each of the vertically extending segments 150, 160, and 165 and cross-member 320 are composed of two or more segments that join at acute angles to create a concave support structure. It should be apparent that the segments 150, 160, and 165 may also include single segments that extend perpendicularly or at an angle from the base.

The body support member 115 provides a backrest against which the actor lays in a supine position during use of the machine 100. The body support member 115 is attached to the vertically extending segment 150 of the lengthwise extending segment 130. In some embodiments, the body support member frame attaches to the vertically extending segment 150 using a lockable hinge mechanism which can be used to alter the angle of the body support member 115 relative to the vertically extending segment 150. In some such embodiments, the actor unlocks the hinge by pulling a lever located underneath the body support member 115. The actor repositions the body support member 115 to a preferred angle and releases the lever whereby the position of the body support member 115 is locked at the actor specified angle. In some embodiments, the angle at which the body support member 115 couples to the frame 110 may be adjusted 15-60 degrees with a preferred angle of 45 degrees from the point at which the body support member 115 contacts the vertically extending segment 150.

Figure 4:
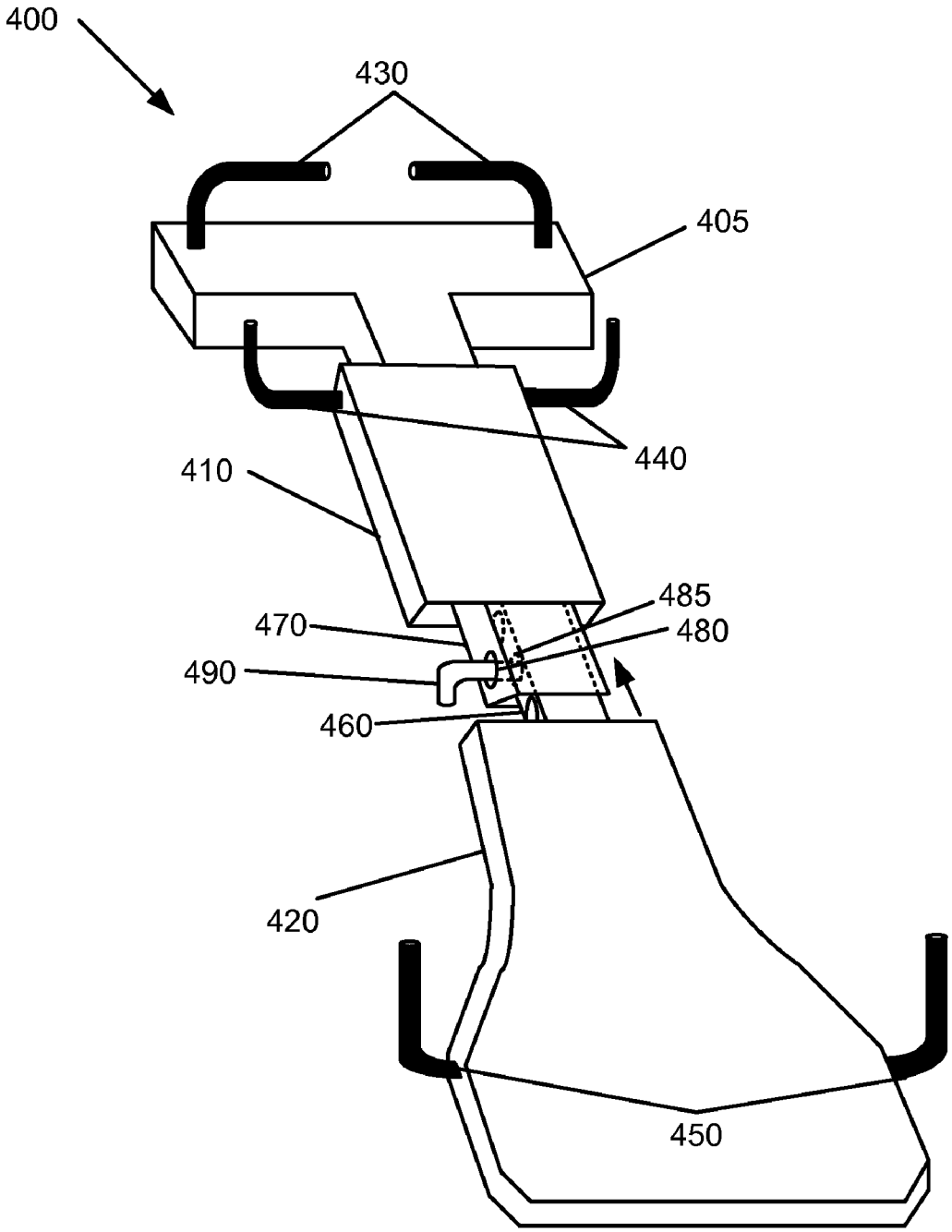
FIG. 4 illustrates the body support member in accordance with some embodiments.

FIG. 4 illustrates the body support member 400 in accordance with some embodiments. The body support member 400 includes a "T" bar frame 405, an upper back support section 410, a lower back support section 420, and sets of hand grips 430, 440, and 450. The body support member 400 may also include a section below the lower back support section 420 that is a seat on which the actor sits. In some embodiments, each section of the body support member 400 is an upholstered cushion.

The sets of hand grips 430, 440, and 450 are used by the actor to maintain body position during exercises. The sets of hand grips 430, 440, and 450 are positioned at different locations along the body support member 400 and may be oriented differently relative to each other. The different positions and orientations of the hand grips 430, 440, and 450 allow the user options with which to maintain the body position as the actor performs the adapted reverse crunching motion of some embodiments. It should be apparent that in some embodiments the position or orientation of the hand grips 430, 440, and 450 may be set and adjusted along different points of the body support member 400.

In some embodiments, the length of the body support member 400 is adjustable. As shown, the lower back support section 420 is coupled to an inner shaft 460 and the upper back support section 410 is coupled to an outer shaft 470. The outer shaft 470 slides over and out from the inner shaft 460 to vary the length of the body support member 400. The upper back support section 410 may slide away from the lower back support section 420 in order to increase the length of the body support member 400 or slide towards the lower back support section 420 in order to decrease the length of the body support member 400.

Each shaft 460 and 470 includes one or more predrilled holes 480 and 485 located along an outward facing side of the shaft. Pin 490 secures the length of the body support member 400 by sliding through a hole 480 of the outer shaft 470 that is aligned with a particular hole of the set of holes 485 of the inner shaft 460. In this manner, the length of body support member 115 ranges from 3-6 feet.

The body support member 115 may include other adjustable features to accommodate users of different heights and body proportions. For example, the bottom of the body support member 115 is elevated 3 feet off of the ground level in some embodiments, though it should be apparent that the height of the body support member 115 may be user adjustable and may be repositioned 2-5 feet off of the ground level. Additionally, it should be apparent to one of ordinary skill that the angle of the upper back support section and the angle of the lower back support section of the support member 115 may be user adjustable.

With reference back to FIGS. 1-3, the rotating resistance members 120 and 125 produce an adapted reverse crunching motion to train the abdominal muscles. The adapted reverse crunching motion is performed using a section of the lower part of the body that is closest to the abdominal muscles (e.g., upper thigh or knee) while the upper body or torso remains stationary. In this manner, there is little to no stress applied to the back and neck which reduces the risk of injury to the actor's neck and back. This is in contrast to ordinary stomach crunching machines and methods where stress is continually placed on the upper body or torso as they are moved to perform the crunching motion.

The adapted reverse crunching motion also has the benefit of placing little to no impact on the knees, ankles, or feet of the actor, because the motion and resistance is isolated to the lower part of the body that is closest to the abdominal muscles. Conversely, leg lifts or typical reverse crunching motions require that the entire leg be used in the motion which causes stress to be applied to the knees and feet especially when resistance weights are used.

Further still, the adapted reverse crunching motion of some embodiments allows for each rotating resistance member 120 and 125 to rotate independent of the other. In this manner, the actor is able to replicate a natural running or walking motion to train the abdominal muscles.

To produce the adapted reverse crunching motion, the rotating resistance members 120 and 125 couple to the vertically extending segments 160 and 165 of the frame 110. The rotating hinges 170 and 175 allow each of the resistance members 120 and 125 to rotate about a longitudinal axis (i.e., y-axis). This rotation replicates the natural motion of the leg at the hip and provides a controlled, natural, and low impact motion that trains the abdominal muscles.

Figure 5:
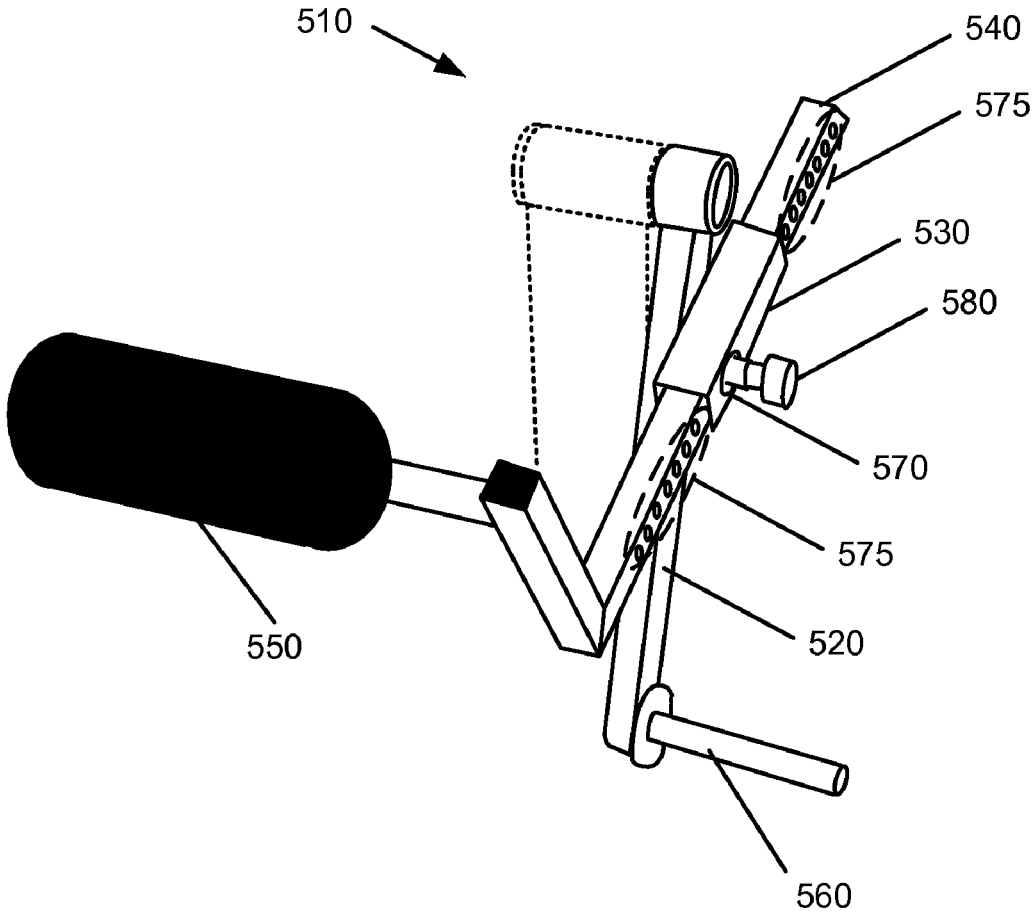
FIG. 5 presents a view of a rotating resistance member of some embodiments separate from the abdominal training machine.

FIG. 5 presents a view of a rotating resistance member 510 of some embodiments separate from the abdominal training machine. The rotating resistance member 510 is composed of a main shaft 520, outer shaft 530, inner shaft 540, pad 550, and weight assembly 560. The main shaft 520 couples the rotating resistance member 510 to a rotating hinge of the abdominal training machine. The outer shaft 530 is attached to the main shaft 520 at an angle of 45 degrees, though the angle may range from 15-60 degrees in some different embodiments.

In some embodiments, the outer shaft 530 is a hollow tube in which the inner shaft 540 slides in to and out from. The outer shaft 530 includes at least one hole 570 that aligns with one of several holes 575 located along the inner shaft 540. Using a pin or screw based mechanism 580, an actor is able to adjust the length of the rotating resistance member 510. The actor slides the inner shaft 540 in to or out from the outer shaft 530 to a desired length. By aligning a hole of the inner shaft 540 with the hole 570 of the outer shaft 530 at the desired length, the actor can secure the length of the inner shaft 540 relative to the outer shaft 530 using the pin or screw based mechanism 580.

In some embodiments, the actor sets the length of each rotating resistance member such that the pad 550 rests above the knee or upper thigh of the actor's legs when his body is placed against the body support member of the machine. It should be apparent that the length of the resistance member and pad 550 may also be adjusted to rest above the ankle of the actor to allow the actor to perform a typical leg lift motion.

The pad 550 is an upholstered cushion from which resistance is transferred from the weight assembly to the actor's legs during rotation of the resistance members.

The resistance is applied directly to the actor's legs at the point of contact between the pad 550 and the actor's leg. However, the actor primarily utilizes the lower abdominal muscles and the oblique abdominal muscles and secondarily utilizes the upper abdominal muscles to generate the force necessary to overcome the resistance and rotate the resistance member. It should be apparent to one of ordinary skill that other muscles are secondarily trained during the adapted reverse crunching motion provided by the abdominal training machine of some embodiments. For example, the gluteus muscles are used to perform the adapted reverse crunching motion.

The resistance is bidirectional and remains constant throughout the entire range of motion (i.e., contraction and extension). This is in contrast to resistance cable training where resistance gradually increases the greater the resistance cable is stretched. An actor is therefore unable to train a full range of motion using resistance cables as the resistance cables provide too much resistance at the end of the motion and too little resistance at the beginning of the motion.

The weight assembly 560 constantly applies resistance throughout the adapted reverse crunching motion. The weight assembly 560 includes a steel peg that protrudes outwards from the base of the main shaft 520 of the resistance member 510. The actor increases the amount of resistance by placing weights onto the weight assembly 560 peg and decreases the amount of resistance by removing weights from the weight assembly 560 peg. The weight assembly 560 utilizes the amount of weight and the gravitational force to counter the actor generated force or upward rotation of the resistance member 510. Specifically, the weight assembly 560 and supported weight retains an angle that is less than parallel with the level of the ground surface throughout the entire range of motion of the rotating resistance member 510. At this position, the weight creates a downward counter-force to the actor generated upward force.

It should be apparent that alternative weight assemblies may be incorporated with the abdominal training machine of some embodiments. For example, the weight assembly of some embodiments includes a cable that connects the bottom of the resistance member main shaft to a weight stack using a series of pulleys. As the resistance member rotates, the cable pulls and lifts the weight stack. The greater the amount of weight on the weight stack, the greater the resistance encountered during the upward rotation of the resistance member.

When the rotating resistance member 510 is not in use, the main shaft 520 and weight assembly 560 have a default resting position that is perpendicular or near perpendicular to the level of the ground surface. The default resting position for the main shaft 520 and the entire rotating resistance member 510 is determined by the stop pegs 180 illustrated in FIGS. 1-3. The stop pegs 180 include rubber stops that are affixed to extensions from the two vertically extending segments 160 and 165 of the widthwise extending segment 135. When the abdominal training machine of some embodiments is not in use, the downward force produced by the weight assembly causes the rotating resistance member to rotate back towards and rest against the stop pegs 180.

II. Operation

Figure 6:
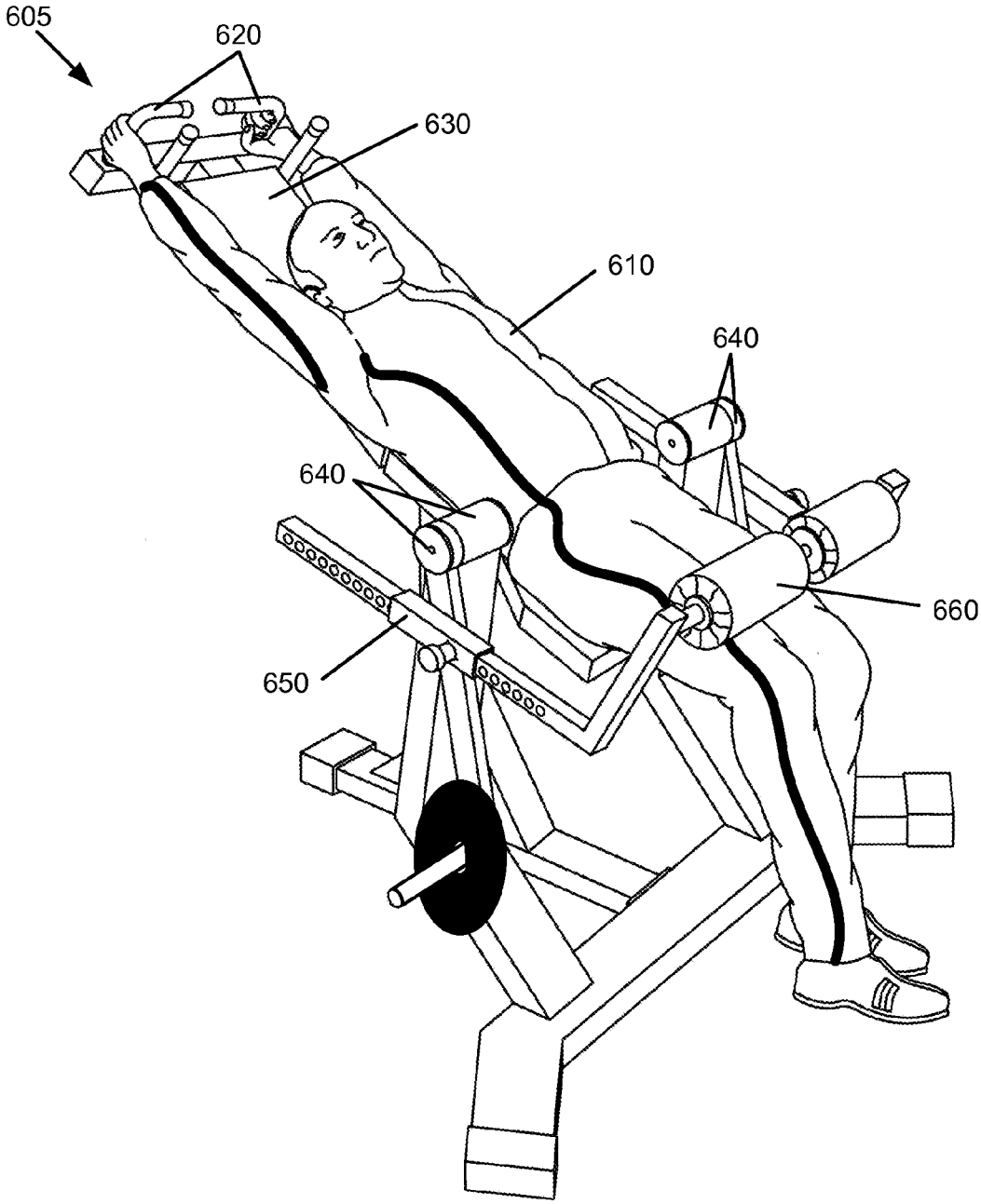
FIG. 6 illustrates the abdominal training machine at a default resting position or at a position prior to the commencement of an adapted reverse crunch in accordance with some embodiments.

FIGS. 6-9 illustrate operation of the abdominal training machine in accordance with some embodiments. FIG. 6 illustrates the abdominal training machine 605 at a default resting position or at a position prior to the commencement of an adapted reverse crunch in accordance with some embodiments. The figure illustrates the body position of the actor 610 relative to the grips 620, body support member 630, rotating hinges 640, rotating resistance member 650, and pad 660 of the abdominal training machine 605.

As shown, the actor 610 lays in a supine position against the body support member 630. The actor 610 grabs the grips 620 to stabilize the body position and prevent movement during exercises. The actor 610 aligns his body such that his hips are in parallel with the rotating hinges 640. This body positioning allows the rotation of the resistance member 650 to replicate the natural movement of the actor's leg at the hip. Specifically, the femur of the leg attaches to the acetabulum (i.e., hip) using a ball and socket joint and the rotating hinges 640 in combination with the rotating resistance member 650 replicate movement of this ball and socket joint.

The actor adjusts the length of the rotating resistance member 650 such that the pad 660 is positioned above and behind the knee (closer to the hips). Additionally, the actor may adjust the amount of resistance provided by the rotating resistance member 650 by placing weights on to the weight assembly of the rotating resistance member 650.

The motion provided by the resistance member 650 produces an adapted reverse crunching motion since each of the actor's legs are able to move independent of the other with an actor specifiable amount of constant resistance applied to each leg. Moreover, the reverse crunching motion is adapted to apply the resistance closer to the abdominal muscles (e.g., over the knee or thigh). This is in contrast to the resistance that is applied by a common reverse crunching motion where the resistance is applied at or near the feet of the actor. Further still, the reverse crunching motion is adapted to allow the actor to remain in an upright position instead of lying on the ground or flat position. The upright body positioning provided by the abdominal training machine of some embodiments facilitates natural blood flow to the abdominal muscles and legs while performing the exercises. This upright body positioning prevents premature fatigue of the muscles from improper blood flow which occurs when the actor lays down or is parallel to the ground surface when performing reverse crunching motions.

Figure 7:
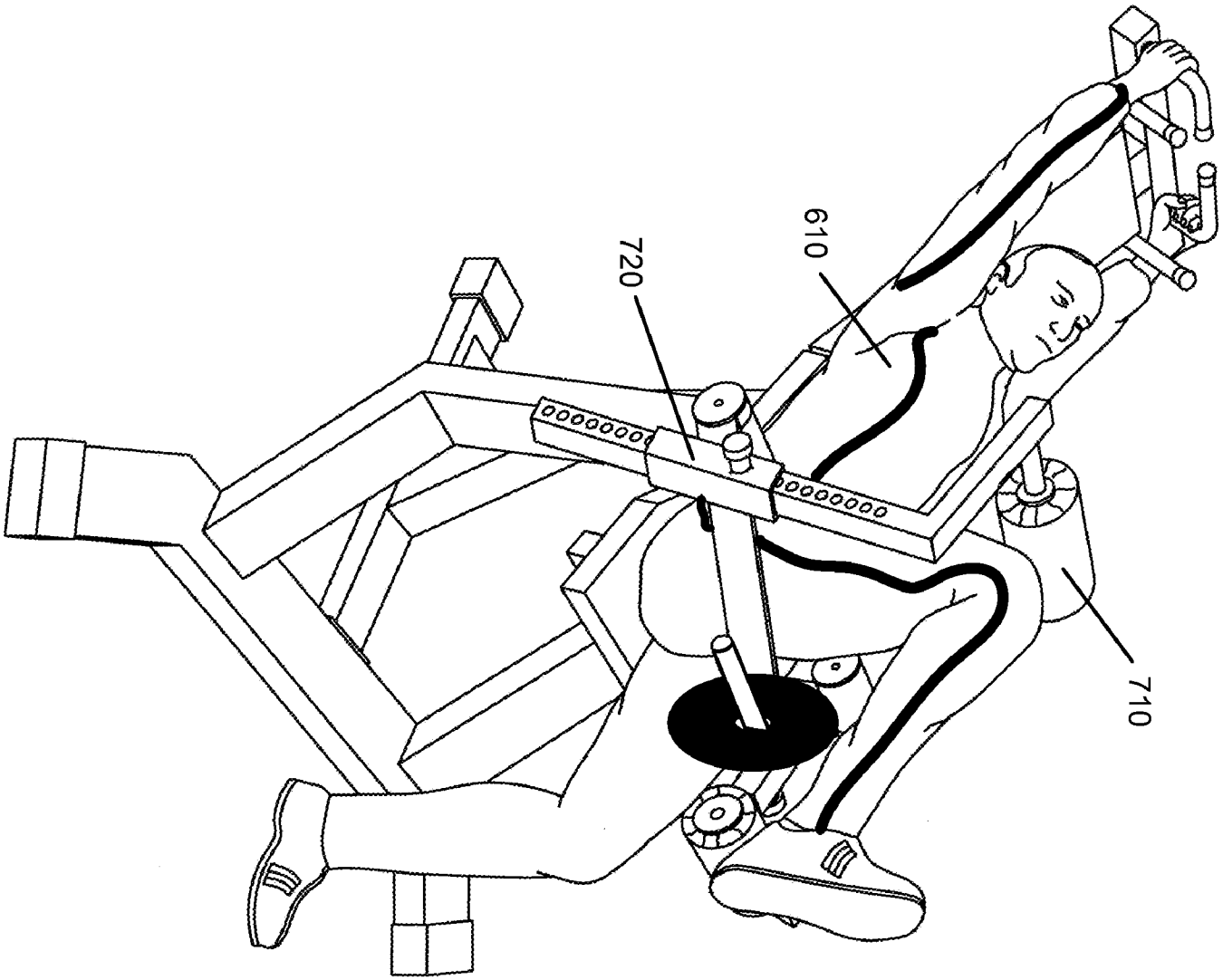
FIG. 7 illustrates the actor of FIG. 6 having completed a contraction for an adapted reverse crunch in accordance with some embodiments.

FIG. 7 illustrates the actor 610 of FIG. 6 having completed a contraction for an adapted reverse crunch in accordance with some embodiments. In FIG. 7, the actor 610 has elevated the right leg to be perpendicular to the upper body. In so doing, the actor 610 produced sufficient force using the abdominal muscles to overcome the counter-force or resistance applied over the knee by the pad 710 of the rotating resistance member 720.

The actor 610 can continue the contraction motion to bring the knee closer to the chest or reverse the motion and begin the extension from the position shown in FIG. 7. The abdominal training machine provides bidirectional resistance training of the abdominal muscles by providing a constant amount of resistance during each of the contraction and extension motions.

To perform resistance training of the abdominal muscles during the extension motion, the actor 610 allows the rotating resistance member 720 to return to its starting position while continually resisting against the downward counter-force of the rotating resistance member 720 as it returns to the starting position. The actor 610 may perform additional repetitions using the same leg or perform additional repetitions while alternating between legs.

Figure 8:
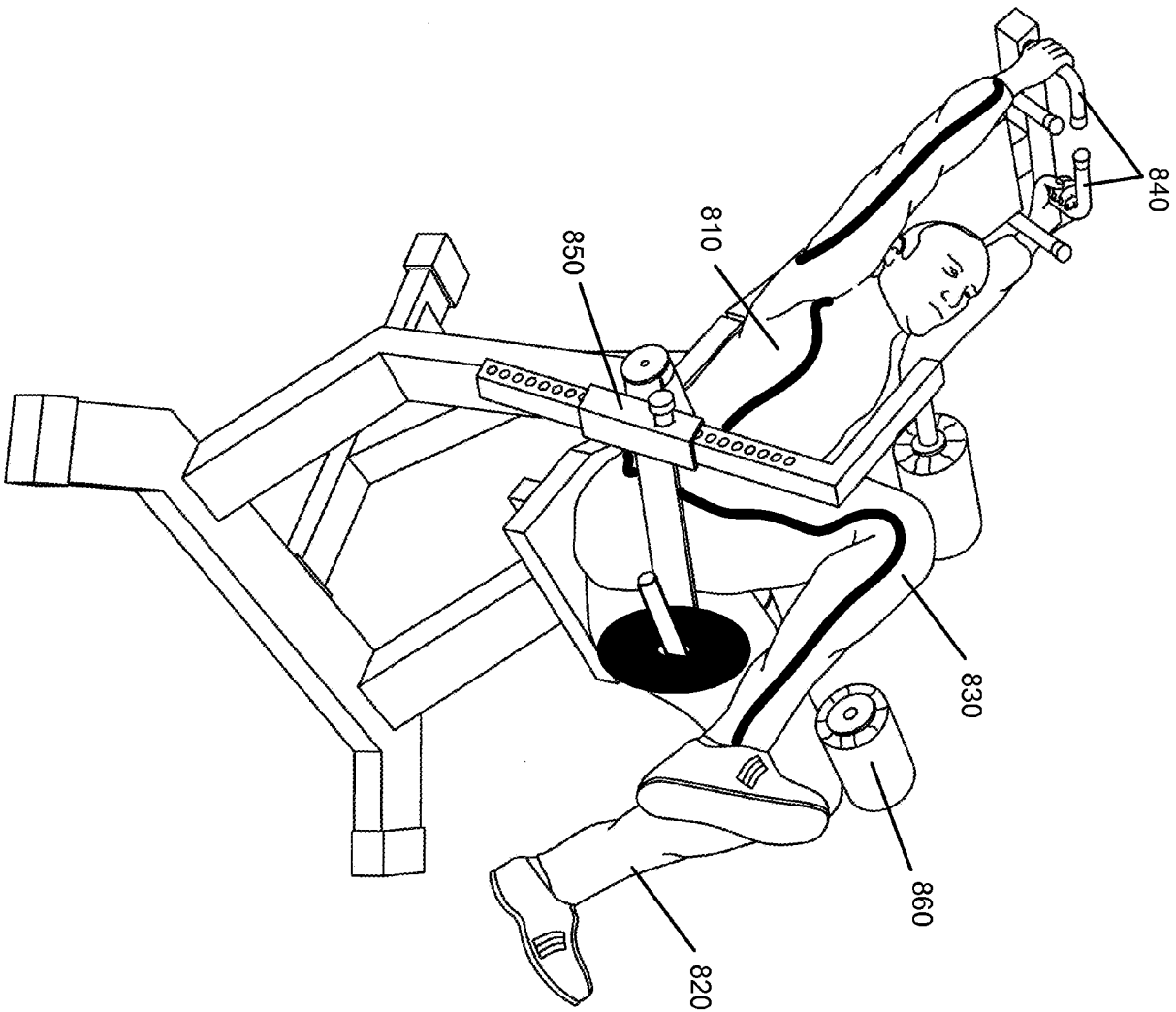
FIG. 8 illustrates an actor performing the adapted reverse crunching motion while alternating legs in accordance with some embodiments.

FIG. 8 illustrates an actor 810 performing the adapted reverse crunching motion while alternating legs in accordance with some embodiments. As shown, the actor 810 does not complete the extension of the adapted reverse crunch performed by the left leg 820 before performing the contraction of the adapted reverse crunch using the right leg 830. The actor 810 retains the body position by grabbing the grips 840 even though both legs are off the ground.

Using the alternating leg motion, the actor 810 is able to train the full set of abdominal muscles (e.g., left and right side). The alternating leg motion replicates a running or walking motion by allowing each leg to move independent of the other. This natural movement decreases the likelihood of injury from undue stress to the neck, back, knees, and other areas commonly overstressed and injured through traditional crunching and reverse crunching motions and machines. Moreover, the motion provides abdominal training using a low impact and controlled motion that is simple for the most basic user to learn.

The actor 810 may use the same or different amount of resistance on each resistance member 850 and 860 to vary the training. Furthermore, by gradually increasing the amount of resistance over time, the actor 810 is able to progressively overload train the abdominal muscles using the abdominal training machine of some embodiments.

It should be apparent that an actor 810 may perform the adapted reverse crunching motion in several different ways than those illustrates in FIGS. 6-8 above. For example, the actor may commence the contraction motion or reverse the extension motion at a point before the resistance member contacts the stop pegs or reaches the default resting position. The actor may continue the contraction motion beyond the perpendicular body position shown in FIG. 8 or the actor may end the contraction motion and begin the extension motion prior to reaching the perpendicular body position. In some embodiments, the actor alternates legs but allows each leg to perform a full contraction and extension before performing the contraction and extension with the other leg. The actor may also move both legs in unison. Some embodiments provide a bar to link the two resistance members together such that the resistance members move in unison.

Figure 9:
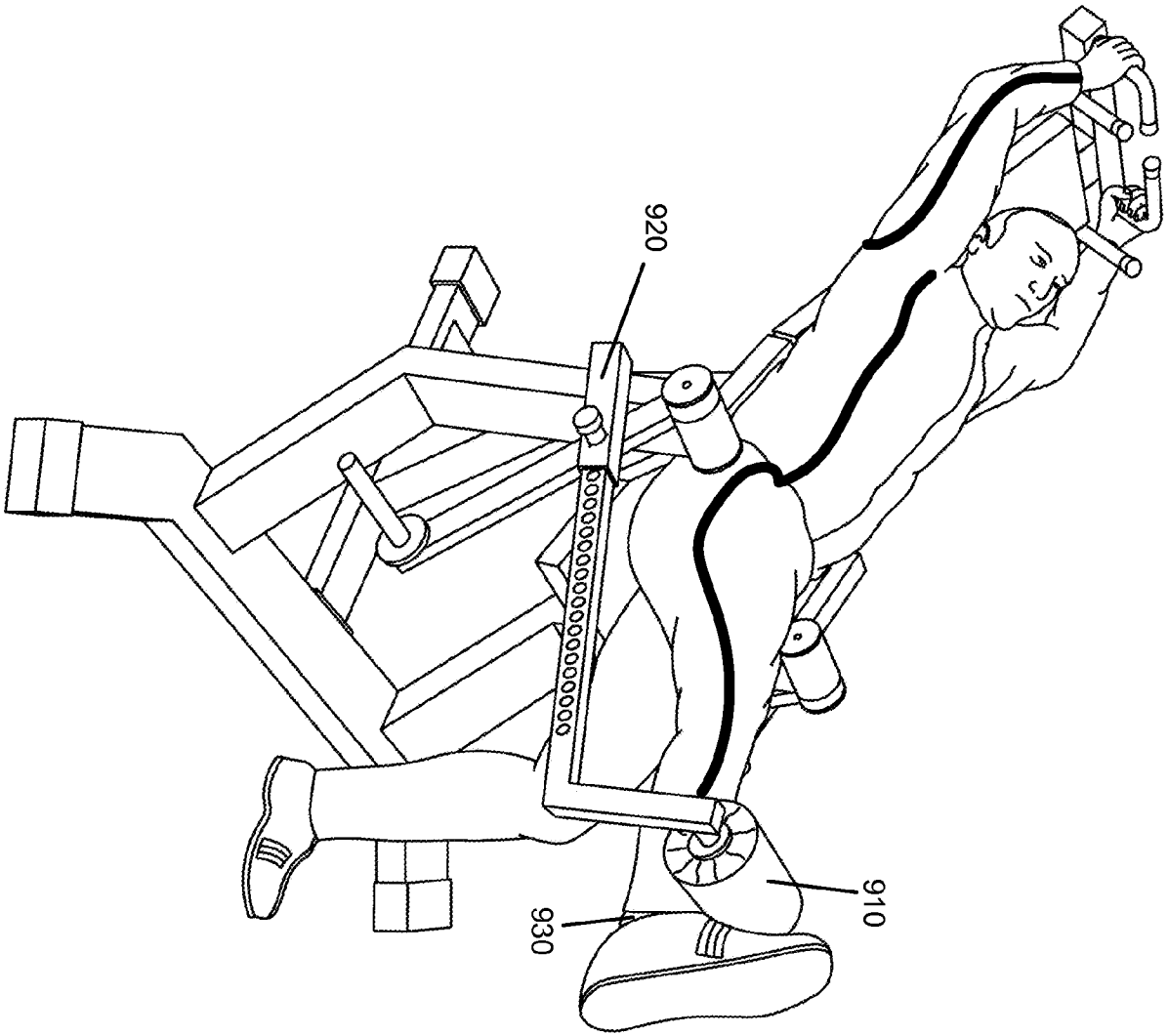
FIG. 9 illustrates using the abdominal training machine of some embodiments to perform a variation of the adapted reverse crunching motion.

FIG. 9 illustrates using the abdominal training machine of some embodiments to perform a variation of the adapted reverse crunching motion. As shown, the pad 910 of the resistance member 920 has been positioned over the ankle 930 of the fully extended leg of the actor. In this configuration, the actor performs reverse crunching motions using a fully extended leg with little to no knee bend. As before, the actor may perform the adapted crunching motion while alternating legs.

III. Modifications

Various modifications may be made to customize and adjust comfort and functionality of the abdominal training machine. FIGS. 10-14 illustrate some such modifications to the abdominal training machine in accordance with some embodiments.

Figure 10:
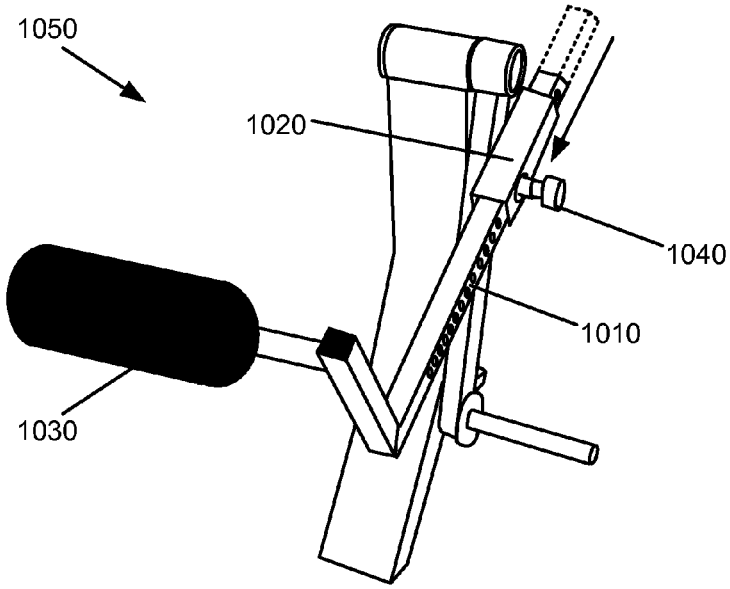
FIG. 10 illustrates adjusting the length of the resistance member to modify a position of the pad in accordance with some embodiments.
Figure 10:
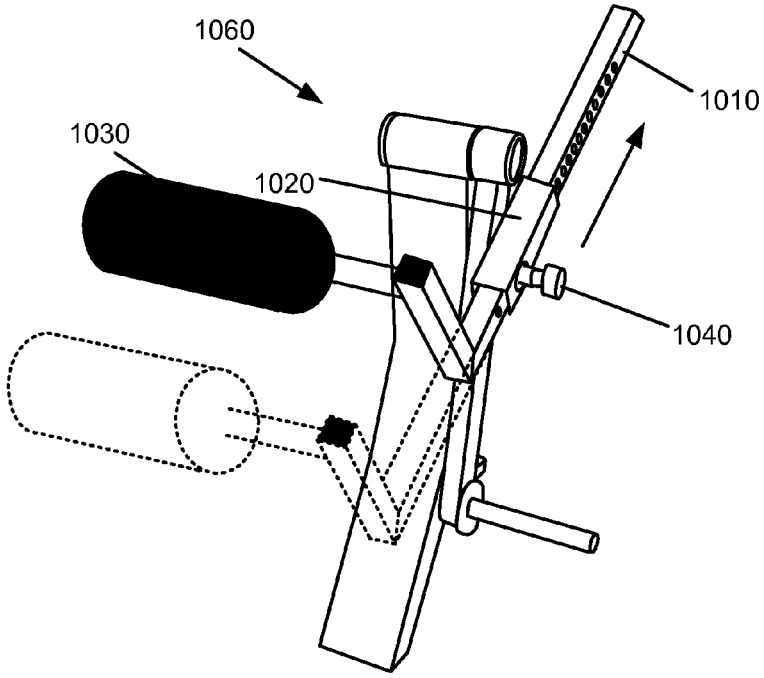

FIG. 10 illustrates adjusting the length of the resistance member to modify a position of the pad in accordance with some embodiments. As described above with reference to FIG. 5, the resistance member includes an inner shaft 1010 that comprises a set of predrilled holes and the outer shaft 1020 includes a single hole. By aligning the hole along the outer shaft 1020 with a different hole along the inner shaft 1010, an actor is able to modify the length of the resistance member and thereby modify a position of the pad 1030 to accommodate actors of different lengths and heights. The length of the resistance member is then secured by a screw based mechanism or pin 1040.

1050 illustrates increasing the length of the resistance member by pulling the inner shaft 1010 away from the outer shaft 1020. 1060 illustrates shortening the resistance member by pushing the inner shaft 1010 towards the outer shaft 1020.

Figure 11:
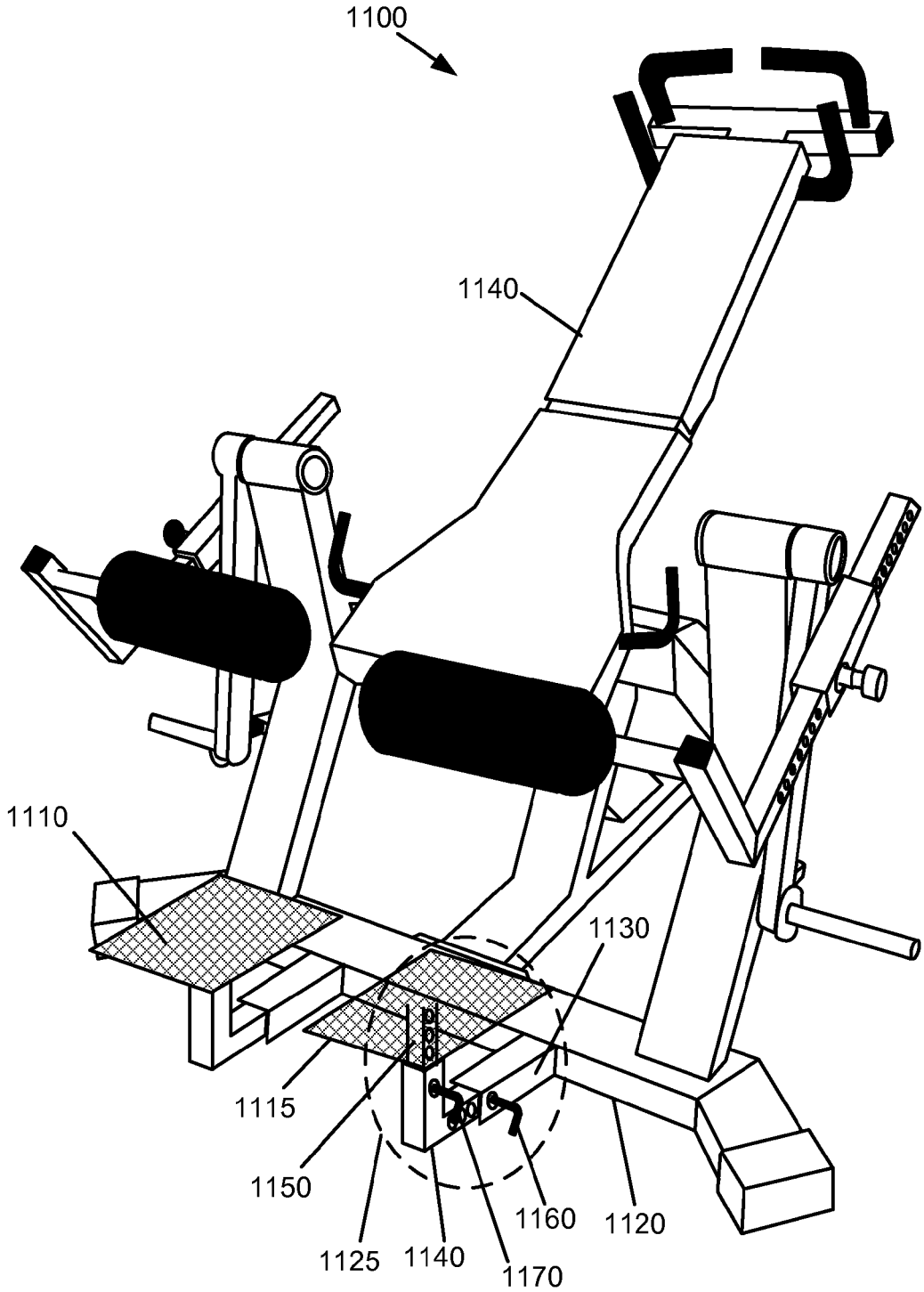
FIG. 11 illustrates a modified abdominal training machine with off-leg supports in accordance with some embodiments.

FIG. 11 illustrates a modified abdominal training machine with off-leg supports 1110 and 1115 in accordance with some embodiments. The off-leg supports 1110 and 1115 provide added body support for the actor performing the adapted reverse crunching motion. When performing a contraction motion or an extension motion with the on-leg (i.e., leg performing the contraction or extension motion), the actor braces the off-leg (i.e., leg not performing a contraction motion or an extension motion) against the corresponding off-leg support 1110 or 1115. The actor's leg contacts the off-leg support thereby stabilizing the lower body of the actor during the adapted reverse crunching motions. This additional support for the lower body allows the actor to transfer greater force through the on-leg while maintaining body position using the off-leg. The actor may alternate between the right and left legs as the off-leg that is used to brace against the corresponding right or left off-leg support 1110 and 1115.

Each off-leg support 1110 and 1115 is attached to a protractible coupling bracket 1125. Each protractible coupling bracket 1125 couples a corresponding off-leg support 1110 or 1115 to the latitudinal extending segment 1120 of the base of the frame. In some embodiments, the protractible coupling bracket 1125 is composed of a frame extension 1130, latitudinal expanding shaft 1140, and longitudinal expanding shaft 1150.

The frame extension 1130 attaches orthogonally to the latitudinal extending segment 1120 of the frame. The latitudinal expanding shaft 1140 slides in to and out from the frame extension 1130. The frame extension 1130 includes a single hole and the latitudinal expanding shaft 1140 includes multiple holes that can be aligned with the hole of the frame extension 1130 in order to adjust the length of the corresponding off-leg support from the latitudinal extending segment 1120 of the frame. A pin 1160 secures the length of the latitudinal expanding shaft 1140 relative to the frame extension 1130.

At one end, the latitudinal expanding shaft 1140 forms an "L" bracket. The longitudinal expanding shaft 1150 slides in to and out from the "L" bracket of the latitudinal expanding shaft 1140 thereby allowing an actor to adjust the height of the corresponding off-leg support. To adjust the height, the actor aligns and secures one of a set of holes located along the longitudinal expanding shaft 1150 with a hole located along the "L" bracket of the latitudinal expanding shaft 1140 using pin 1170.

In some embodiments, the off-leg supports 1110 and 1115 are angled to be parallel to the ground though this angle may be greater or less in different embodiments. In some embodiments, the angle of the off-leg supports 1110 and 1115 are user adjustable via a lockable hinge mechanism that couples the off-leg support to the corresponding longitudinal expanding shaft of the corresponding protractible coupling bracket. The lockable hinge mechanism allows the angle of the off-leg supports 1110 and 1115 to rotate up to 60 degrees from the parallel position to replicate the dorsiflexion about the ankle of the actor's foot. By adjusting the angle of the off-leg supports, an actor can cause a different contact point between the off-leg supports and the actor's leg or foot. In some embodiments, the off-leg supports 1110 and 1115 are solid metal plates or cushioned pads.

Figure 12:
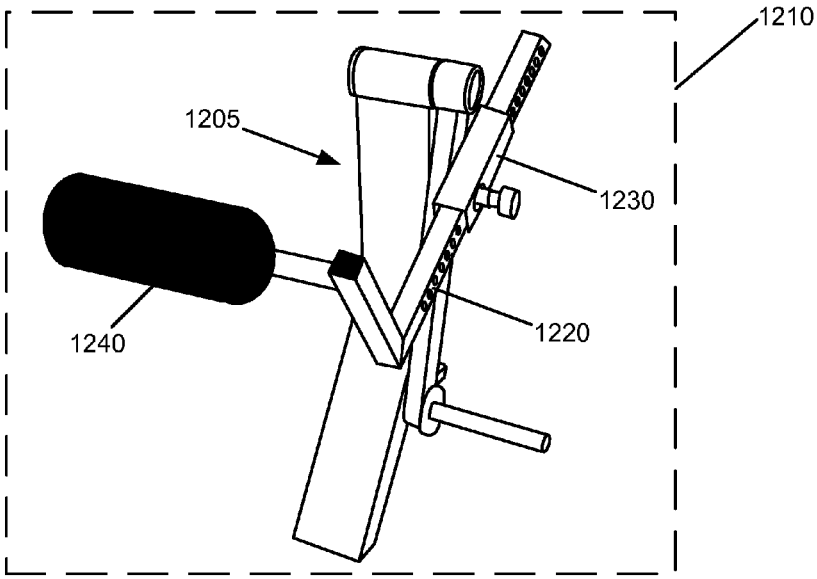
FIG. 12 illustrates inverting and swapping the inner shafts of rotating resistance members to provide a modified comfort setting for the actor in accordance with some embodiments.
Figure 12:
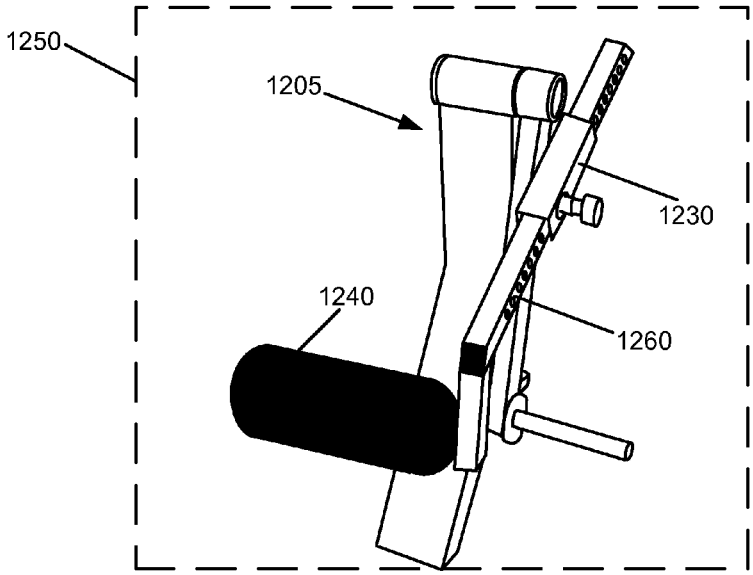

FIG. 12 illustrates inverting and swapping the inner shafts of rotating resistance members to provide a modified comfort setting for the actor in accordance with some embodiments. At 1210, inner shaft 1220 is inserted into the outer shaft 1230 of the rotating resistance member 1205 such that the pad 1240 is some distance above the inner shaft 1220. 1250 shows the resistance member 1205 with the inner shaft 1260 of the opposite resistance member being inverted and inserted into the outer shaft 1230 of the resistance member 1205. By inverting and swapping the inner shafts, the pad 1240 becomes positioned some distance below the inner shaft 1260.

To perform the inversion and swapping of the inner shafts 1220 and 1260, each inner shaft 1220 and 1260 is modified to include a set of holes along both horizontally facing sides of the shaft. The dual set of holes enable the screw based mechanism or pin of the outer shaft 1230 to secure the position of the inner shafts 1220 and 1260 irrespective of whether the inner shafts 1220 and 1260 are inserted with the pad above the shaft or inverted with the pad below the shaft. As before, the actor aligns the hole of the outer shaft 1230 with any hole along either side of the inner shafts 1220 and 1230 and secures the position by screwing or inserting a pin through the aligned holes.

Figure 13:
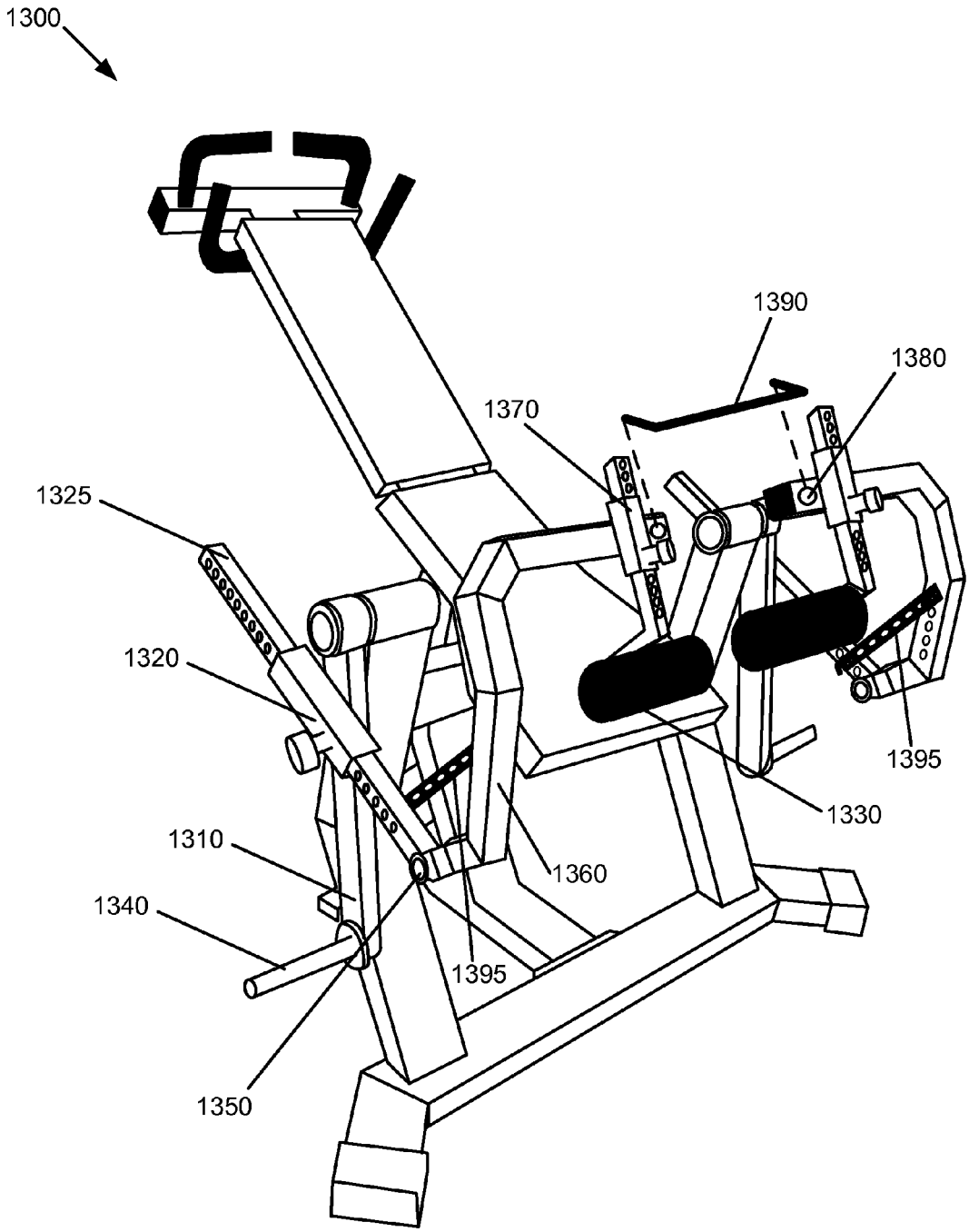
FIG. 13 illustrates the abdominal training machine of some embodiments with modified rotating resistance members.

The modification of FIG. 12 adjusts the height of the pad to suit the comfort specifications of some actors. The modification also allows for a different lower starting position for the abdominal training machine. It should be apparent to one of ordinary skill in the art that further height adjustments may be made to the pad by modifying the resistance members to include a similar mechanism as that used in FIG. 10 to adjust the length of the rotating resistance member. FIG. 13 below illustrates such a modification.

FIG. 13 illustrates the abdominal training machine of some embodiments with modified rotating resistance members. As shown in FIG. 13, the abdominal training machine 1300 includes the frame and body support member as in FIGS. 1-3. However, the rotating resistance members are modified. Each rotating resistance member includes the main shaft 1310, outer shaft 1320, inner shaft 1325, pad 1330, and weight assembly 1340 as in FIG. 5. Additionally, each rotating resistance member is modified to include rotating hinge 1350, angled shaft 1360, adjustable height bracket 1370, linking hole 1380, and support arm 1395.

The angled shaft 1360 couples to the inner shaft 1325 using the rotating hinge 1350. Specifically, a first bracket of the rotating hinge 1350 is attached to the base of the angled shaft 1360 and a second bracket of the rotating hinge 1350 is attached to the base of the inner shaft 1325. The brackets are linked together using a nut and bolt assembly which allows the brackets to rotate about the bolt. The rotating hinge 1350 therefore couples the angled shaft 1360 to the inner shaft 1325 while providing longitudinal rotation of the angled shaft 1360 about the base of the inner shaft 1325.

The rotation of the angled shaft 1360 about the base of the inner shaft 1325 provides additional flexibility with regards to the position of the pad 1330. Specifically, this rotation flexes the position of the pad 1330 throughout the full range of the adapted reverse crunching motion. In some embodiments, the flexibility provides additional comfort to some actors using the machine. In some embodiments, the flexibility maintains the pad 1330 in a stationary position along the actor's leg throughout the full range of motion of the resistance member.

Some embodiments include the support arm 1395 to limit the amount of rotation of the angled shaft 1360 about the inner shaft 1325. The support arm 1395 also specifies the amount of inclination for the angled shaft 1360 relative to the inner shaft 1325 and provides a default resting position for the angled shaft 1360.

The support arm 1395 couples to the inner shaft 1325 at one end and to the angled shaft 1360 at the opposite end. The position of the support arm 1395 along the inner shaft 1325 and the angled shaft 1360 is user adjustable. To adjust the position, an actor aligns one of a set of holes located along the support arm 1395 with holes located along the side of the inner shaft 1325 and the angled shaft that face the center of the machine 1300. By aligning holes along the support arm 1395 with a particular hole along the inner shaft 1325 and the angled shaft 1360, the actor is able to adjust the radial movement of the angled shaft 1360 relative to the inner shaft 1325. In doing so, the actor controls the inclination and amount of rotation of the angled shaft 1360 relative to the inner shaft 1325. The position of the support arm 1395 is secured along the inner shaft 1325 and angled shaft 1360 using a screw, knob, or pin.

The support arm 1395 is fixed in length but provides for rotation about the holes that connect the support arm 1395 to the inner shaft 1325 and the angled shaft 1360. In this manner, support arm 1395 determines radial movement of the angled shaft 1395 about the inner shaft 1325.

Figure 14:
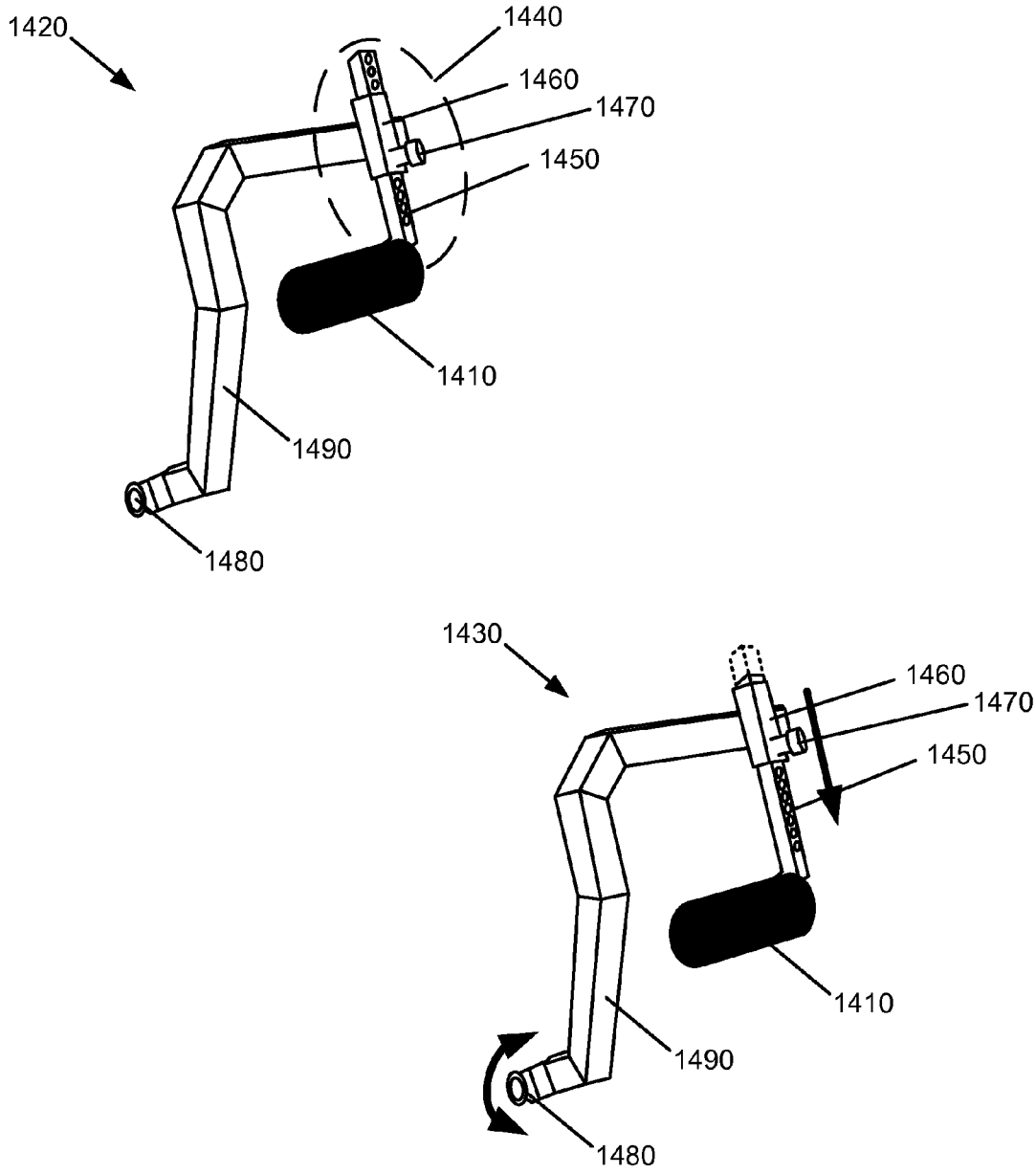
FIG. 14 illustrates the adjustability and flexibility of the modified rotating resistance member of some embodiments.

At the end of each angled shaft 1360 is a laterally extending peg that extends from the angled shaft 1360 towards the center of the machine 1300. The peg passes through the pad 1330. In this manner, the peg holds the pad 1330 in position over the actor's leg from an external side of the pad 1330 (i.e., side facing away from the center of the machine 1300). The angled shaft 1360 positions the pad 1330 higher above the actor's leg and the adjustable height bracket 1370 allows the actor to reposition the pad 1330 along the longitudinal axis. It should be apparent to one of ordinary skill in the art that the length of the angled shaft 1360 may be user adjustable via a similar inner shaft and outer shaft mechanism as that of the resistance members. FIG. 14 illustrates the adjustability and flexibility of the modified rotating resistance member of some embodiments.

In FIG. 14, the height of the pad 1410 is lowered from 1420 to 1430 using the adjustable height bracket 1440. The adjustable height bracket 1440 includes an inner shaft 1450 and outer shaft 1460. The inner shaft 1450 includes a set of holes that may be aligned with a single hole within the outer shaft 1460. By aligning the different holes, users are able to adjust the height of the pad 1410. A screw based mechanism or pin 1470 secures the position of the pad 1410.

The adjustable height bracket 1440 allows for flexibility to the height of the pad 1410 before the abdominal training machine is in use. However, the hinge 1480 allows for flexibility to the position of the pad 1410 while the abdominal training machine is in use. Specifically, the hinge 1480 allows the angled shaft 1490 to rotate independent of the rotation of the resistance member. This flexibility allows for the pad 1410 to remain in a stationary position along the actor's leg while the actor performs the adapted reverse crunching motion.

The linking holes 1380 allow for the resistance members to be linked. Linking the resistance members causes them to move in unison thereby allowing an actor to train both legs in a single motion. Bar 1390 may be inserted into the linking holes 1380 to link the resistance members.

It should be apparent that other modifications may be made to the abdominal training machine to provide additional customizations and comfort settings. For example, in some embodiments, the inner and outer shafts of the resistance members may be angled or curved instead of straight to modify the arcing trajectory of the resistance member rotation.

While the invention has been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

I claim:

1. An abdominal training machine comprising:

a frame comprising (i) a base for stabilizing said machine, (ii) a first support arm extending upward from said base with a first pivot point and a first stop peg, and (iii) a second support arm extending upward from said base in parallel to said first support arm with a second pivot point and a second stop peg;

a linearly angled backrest that is linearly inclined with respect to the ground surface and that is attached to said frame at a position in between said first and second support arms with a vertical offset below said first and second pivot points at a position of said first and second pivot points, wherein said backrest supports a user in a supine position with hips of the user in alignment with the first and second pivot points;

a first resistance member connected to said first pivot point and for rotating about a first side of the backrest at said first pivot point; and a second resistance member connected to said second pivot point and for rotating about a second side of the backrest at said second pivot point, wherein each particular resistance member of said first and second resistance members comprises:

(i) a first shaft extending downwards from a pivot point to abut one of said first and second stop pegs of said first and second support arms to establish a default starting position of the particular resistance member, said first shaft comprising a weight assembly for adjusting an amount of weight used as resistance against an upward arcing rotation of the particular resistance member; and (ii) a second shaft comprising a pad against which to generate sufficient force to overcome resistance applied to the first shaft and cause said upward arcing rotation of the particular resistance member along an arcing trajectory with a position of the pad following movement of a user's leg along said arcing trajectory from said default starting position with the user's leg about parallel with the user's upper body to an end position with the user's leg in front and about perpendicular with the front facing side of the user's upper body, and wherein the default starting position for the particular resistance member positions said first shaft about vertical and said second shaft about parallel with said linearly angled backrest.

2. The abdominal training machine of claim 1, wherein a length of the second shaft for each particular resistance member is adjustable to position said pad above at least one of an upper leg of the user and a lower leg of the user, wherein the upper leg comprises a region between the user's hips and knee and the lower leg comprises a region between the user's knee and foot.

3. The abdominal training machine of claim 1, wherein the second shaft of each particular resistance member further comprises (i) an adjustable knob, (ii) an inner shaft comprising a set of holes and said pad, and (iii) an outer shaft comprising at least one hole, wherein said adjustable knob screws into the hole of the outer shaft that is aligned with a particular hole from the set of holes of the inner shaft to adjust a position of the second shaft relative to the first shaft.

4. The abdominal training machine of claim 1, wherein the second shaft of each particular resistance member further comprises (i) a pin, (ii) an inner shaft comprising a set of holes and said pad, and (iii) an outer shaft comprising at least one hole, wherein said pin slides into the hole of the outer shaft that is aligned with a particular hole from the set of holes of the inner shaft to adjust a position of the second shaft relative to the first shaft.

5. The abdominal training machine of claim 1, wherein the linearly angled backrest comprises a set of hand grips at a top end of the linearly angled backrest, wherein said set of hand grips is used to maintain a user body position when the user applies force against a pad of at least one of said first and second resistance members.

6. The abdominal training machine of claim 5, wherein said set of hand grips comprise a first pair of hand grips vertically extending away from said backrest and a second pair of hand grips horizontally extending towards each other.

7. The abdominal training machine of claim 1, wherein said pad is for positioning above the leg of the user when the user's leg is about extended substantially straight and said force generated against said pad is generated by said user raising the user's upper leg towards a position that is in front and perpendicular with the front facing side of the linearly angled backrest.

8. The abdominal training machine of claim 1, wherein said weight assembly of each first shaft of each resistance member comprises a bar extending horizontally away from the frame for supporting various combinations of free weights, wherein said combinations of free weights alter the amount of resistance for the particular resistance member.

9. The abdominal training machine of claim 1, wherein the first and second resistance members rotate independent of one another.

10. The abdominal weight training machine of claim 1, wherein the upward arcing rotation of each resistance member follows natural frontal arcing rotation of a human leg at the hips.

11. The abdominal weight training machine of claim 1, wherein the frame comprises at least one off-leg support that is used to brace the lower body of the user with the user's off-leg, said off-leg support comprising a contact surface against which to brace the lower body of the user, and an adjustable height and length "L" bracket for adjusting a position of the contact surface.

12. A weight training machine comprising:

a frame comprising (i) a base for stabilizing said machine, (ii) a first support arm with a first rotating hinge, and (iii) a second support arm with a second rotating hinge;

a linearly angled backrest that is linearly angled with respect to a ground surface and that is linked to said frame at a position in between said first and second support arms with a vertical offset below said first and second rotating hinges at a position of said first and second rotating hinges, wherein said linearly angled backrest supports a user in a supine position with hips of the user in alignment with said first and second rotating hinges;

first and second resistance members for rotating about each side of the frame, each resistance member comprising:

(i) a primary shaft connected to one of said first and second rotating hinges with a default starting position that extends vertically downwards from the connected to rotating hinge, said primary shaft comprising a peg to support a user specifiable amount of weight used as resistance against an upward arcing rotation of said resistance member;

(ii) a secondary shaft comprising a pad and a mechanism for adjusting a length of the secondary shaft, wherein said secondary shaft is coupled to the primary shaft to establish the default starting position for said secondary shaft about parallel with a plane of the backrest and for said pad above the plane of the backrest, wherein said mechanism is for aligning said pad over a leg of the user when the user is in the supine position with the leg about parallel with the user torso, and wherein said pad is used to overcome the resistance applied by the primary shaft and to cause the upward arcing rotation of said resistance member from the default starting position by contacting said pad against the leg of the user when the user raises the leg from the default starting position that is about parallel with the user torso to an end position that is in front and about perpendicular with the front facing side of the user torso.

13. The weight training machine of claim 12, wherein the position of the secondary shaft is adjustable relative to the primary shaft to allow for said pad to be.

14. The weight training machine of claim 12, wherein said upward arcing rotation of the resistance member replicates a flexion motion rotation of the user's leg at the hips.

* * * * *